US011248382B1

(12) United States Patent
Magnusen et al.

(10) Patent No.: US 11,248,382 B1
(45) Date of Patent: Feb. 15, 2022

(54) CLIMBING SUPPORT SUBSYSTEM

(71) Applicant: Peri GmbH, Weissenhorn (DE)

(72) Inventors: David Magnusen, Chicago, IL (US); Klaus Wyld, Elkridge, MD (US); Willi Scheel, Elkridge, MD (US); Peter Kraemer, Elkridge, MD (US)

(73) Assignee: Peri AG, Weissenhorn (DE)

( * ) Notice: Subject to any disclaimer, the term of this patent is extended or adjusted under 35 U.S.C. 154(b) by 0 days.

(21) Appl. No.: 17/094,502

(22) Filed: Nov. 10, 2020

(51) Int. Cl.
*E04G 11/28* (2006.01)
*E04G 11/06* (2006.01)

(52) U.S. Cl.
CPC ..... *E04G 11/28* (2013.01); *E04G 2011/067* (2013.01)

(58) Field of Classification Search
CPC ..... E04G 11/28; E04G 2011/067
See application file for complete search history.

(56) References Cited

U.S. PATENT DOCUMENTS 3,973,885 A * 8/1976 Schmidt ..... E04G 11/24 425/65
6,260,311 B1 * 7/2001 Vladikovic ..... E04G 11/28 249/20
2007/0096006 A1 * 5/2007 Pauley ..... E04G 11/28 249/20
2020/0332539 A1 * 10/2020 Deifel ..... E04G 11/28
2021/0198908 A1 * 7/2021 Liu ..... E04G 3/28

FOREIGN PATENT DOCUMENTS

| | | | | |
|---|---|---|---|---|
| CA | 2260364 | A1 * | 7/2000 | E04G 11/28 |
| CA | 3020211 | | 10/2017 | |
| CA | 3020211 | A1 * | 10/2017 | E04G 11/28 |
| CN | 104652807 | B | 8/2016 | |
| CN | 107178213 | A | 9/2017 | |
| CN | 209323962 | U | 8/2019 | |
| CN | 210713744 | U | 6/2020 | |
| DE | 3842094 | A1 * | 6/1990 | E04G 11/28 |
| DE | 102016205956 | A1 | 10/2017 | |
| EP | 0018014 | A2 * | 10/1980 | E04G 11/28 |
| FR | 2487410 | A1 * | 1/1982 | E04G 11/28 |
| WO | WO-9813565 | A1 * | 4/1998 | E04G 11/28 |
| WO | WO-2013110126 | A1 * | 8/2013 | E04G 11/28 |
| WO | 2017174473 | | 10/2017 | |

OTHER PUBLICATIONS

"PERI ACS Core 400—The efficient and powerful self-climbing formwork for high-rise building cores with innovative climbing hydraulics." Published Jan. 2018.
"ACS Core 400 (EN)," https://www.youtube.com/watch?v=sforIL7rU3Q. Published Jun. 3, 2019.

* cited by examiner

*Primary Examiner* — Michael Safavi
(74) *Attorney, Agent, or Firm* — Loginov & Associates, PLLC; William A. Loginov

(57) ABSTRACT

A climbing support subsystem usable with a self-climbing system for multi-sided cores having three walls or an otherwise non-rectangular or non-square building core.

25 Claims, 7 Drawing Sheets

CLIMBING SUPPORT SUBSYSTEM

FIELD OF THE INVENTION

This invention relates to self-climbing systems and methods of use, in particular a climbing support subsystem adapted for use with a three-sided building core.

BACKGROUND OF THE INVENTION

In construction, self-climbing units are used, for example, in the construction of vertically-oriented concrete building structures, such as building cores, bridges, retaining walls, and the like. An example of one such self-climbing system is described in CA 3020211 assigned to PERI GmbH, the entire contents of which are incorporated herein by reference.

Such building cores are typically rectangular, square-shaped, and are four-sided. This allows for existing climbing systems leverage the four walls of the core to counteract the significant lateral forces that result from the use of a concrete placing boom while also being able to move vertically (e.g., jump) from floor to floor in an efficient manner. In some markets, building core designs can be three-sided or are otherwise not rectangular or square-shaped. This poses a problem for existing climbing systems in that there is no fourth wall to leverage or stabilize against during a climbing operation of the concrete placing boom.

SUMMARY OF THE INVENTION

The present application overcomes the disadvantages of the prior art by providing a climbing support subsystem usable with a self-climbing system for multi-sided cores having three walls or an otherwise non-rectangular or non-square building core.

One aspect of the disclosure provides a climbing support subsystem for use with a self-climbing system, comprising: a plurality of guiding shoes configured to engage with one or more slabs of a multi-wall core, each of the guiding shoes having a bearing surface; at least one front vertical support member configured to engage with a support frame of a self-climbing system; at least one rear vertical support member configured to engage with the support frame of a self-climbing system; and a plurality of braces extending between the at least one front vertical support member and the at least one rear vertical support member, wherein, during a climbing operation, the at least one front vertical support member is configured to bear against the respective bearing surfaces of the plurality of guiding shoes.

In one example, the multi-wall core comprises a three-walled core defining an open face.

In one example, the respective bearing surfaces comprise roller bearing surfaces.

In one example, the subsystem further comprises a temporary truss configured to engage with walls of the multi-wall core.

In one example, the at least one front vertical support member comprises a plurality of front vertical support members, and the at least one rear vertical support member comprises a plurality of rear vertical support members.

In one example, the plurality of front vertical support members bear against a plurality of second bearing surfaces of the temporary truss.

In one example, each of the plurality of braces engages with both the at least one front vertical support member and the at least one rear vertical support member.

In one example, the plurality of guiding shoes are configured to engage with the slabs in a clamping arrangement.

In one example, the climbing support subsystem is configured to be disposed within the multi-sided core.

Another aspect of the disclosure provides a self-climbing system comprising: a plurality of working brackets configured to engage with walls of a multi-sided core to support a support frame; a plurality of climbing brackets configured to engage with walls of the multi-sided core; and a climbing support subsystem, comprising: a plurality of guiding shoes configured to engage with a slab of a multi-wall core, each of the guiding shoes having a bearing surface; at least one front vertical support member suspended from the support frame; at least one rear vertical support member suspended from the support frame; and a plurality of braces extending between the at least one front vertical support member and the at least one rear vertical support member, wherein, during a climbing operation, the plurality of front vertical support members are configured to bear against the respective bearing surfaces of the plurality of guiding shoes.

In one example, the system further comprises: a plurality of climbing cylinders configured to engage with the plurality of working brackets and the plurality of climbing brackets.

In one example, the plurality of climbing cylinders comprise single-stroke hydraulic climbing cylinders.

In one example, the climbing support subsystem is disposed within the multi-sided core.

In one example, the at least one front vertical support member is engaged with the support frame.

In one example, the multi-wall core comprises a three-walled core defining an open face.

In one example, the respective bearing surfaces comprise roller bearing surfaces.

In one example, the climbing support subsystem further comprises a temporary truss configured to engage with walls of the multi-wall core.

In one example, the at least one front vertical support member comprises a plurality of front vertical support members, and the at least one rear vertical support member comprises a plurality of rear vertical support members.

In one example, the plurality of front vertical support members bear against a plurality of second bearing surfaces of the temporary truss.

In one example, the system further comprises a second support frame suspended from the support frame by the plurality of front vertical support members engaged with the support frame and the second support frame and the plurality of rear vertical support members engaged with the support frame and the second support frame.

In one example, each of the plurality of braces engages with both the at least one front vertical support member and the at least one rear vertical support member.

In one example, the support frame extends between two parallel walls of the multi-sided core.

Another aspect of the disclosure provides a method of operating a self-climbing system relative to a multi-side core, comprising: disengaging at least one working bracket from at least a first anchor point of the multi-side core; climbing the at least one working bracket and at least one support frame engaged with the at least one working bracket, during the climbing, guiding a plurality of front vertical supports suspended from the support frame via a plurality of guiding shoes engaged with at least one slab of the multi-side core; engaging the at least one working bracket with a second anchor point of the wall section of the multi-side core above the first anchor point; disengaging at least one climbing bracket from a third anchor point of the multi-side core; and climbing the at least one climbing bracket to the second anchor point.

In one example, during the climbing of the at least one working bracket, the plurality of front vertical supports bear against a bearing surface of the plurality of guiding shoes.

In one example, the bearing surface comprises a roller bearing surface.

BRIEF DESCRIPTION OF THE DRAWINGS

The invention description below refers to the accompanying drawings, of which.

DETAILED DESCRIPTION

Figure 1A:
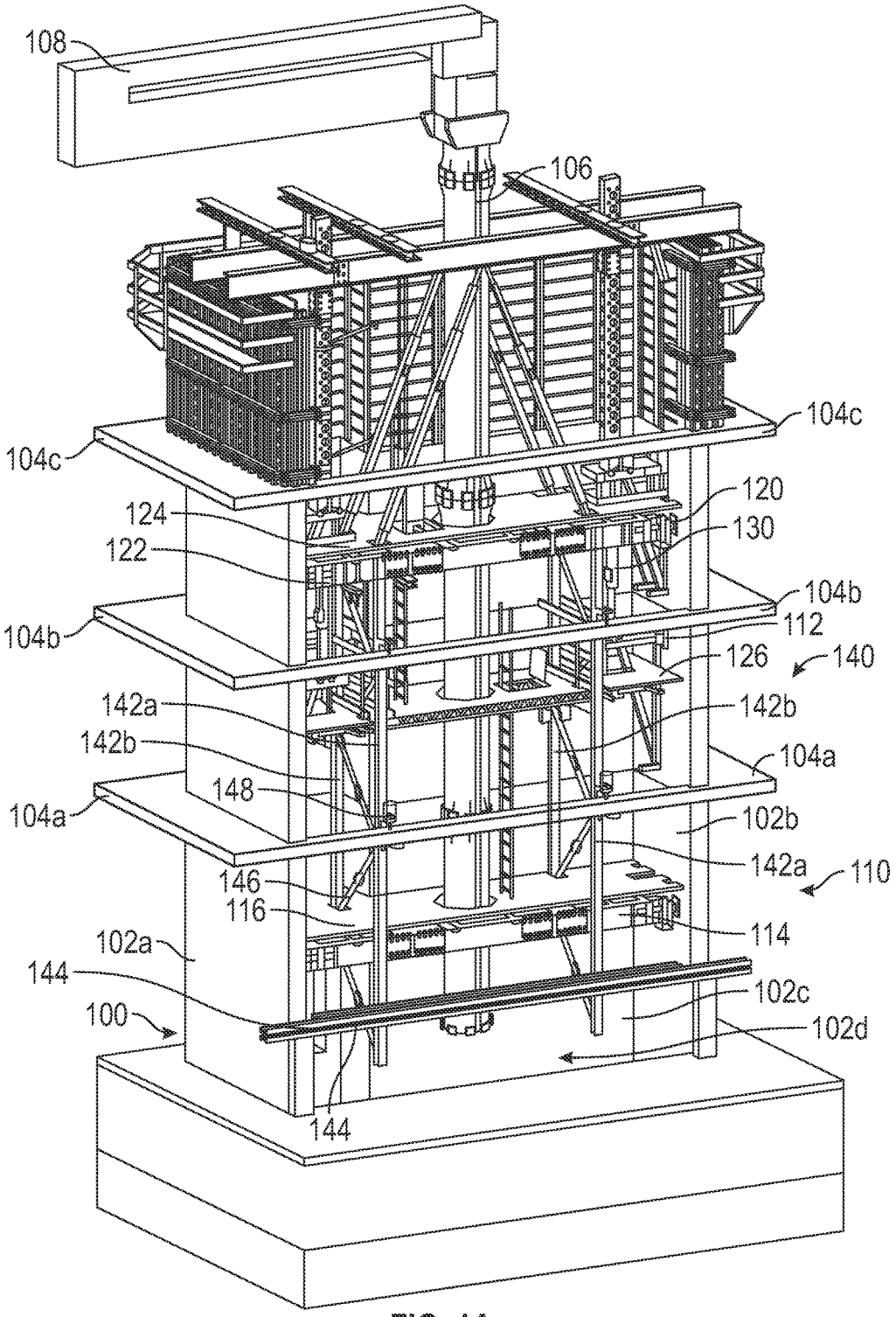
FIGS. 1A-C are front perspective, front, and side views of a multi-sided core with a self-climbing system according to one or more aspects of the disclosure.

FIG. 1A is a front perspective view of a multi-sided core 100 (also referred to as a multi-wall core) with a self-climbing system 110 according to one or more aspects of the disclosure. As shown, the multi-sided core 100 has a plurality of sides or walls, including a left side wall 102*a*, right side wall 102*b*, and rear wall 102*c*. In this example, the multi-sided core 100 is free of a fourth wall that would be opposed, and/or in some examples parallel, to the rear wall 102*c*, thereby defining an open face or open wall 102*d* and ultimately defining a three-sided or three-walled core.

The side walls 102*a-b* are generally parallel with one another, but can be skewed or titled relative to one another according to other examples. The rear wall 102*c* is generally perpendicular to one or both of side walls 102*a-b*, but can also be skewed or tilted according to other examples. While the multi-sided core 100 is depicted as having three walls, it is contemplated that the multi-sided core 100 can have any number of walls, for example, the rear wall can comprises several sub-walls that are arranged at various angles relative to one another or can have any type of polygonal shape.

The multi-sided core 100 can be part of a building or infrastructure core that is used for the subsequent vertical transportation or technical infrastructure of a building not shown in detail. Such infrastructure cores usually represent the static backbone of buildings and in particular can also form supports for ceilings of the building. Concrete building structures may have a polygonal, in particular a rectangular, elliptical or circular cross-sectional shape. In operation, the concrete structure is to be extended vertically in a floor-by-floor manner in a series of fresh concrete operations.

The multi-sided core 100 can also include one or more slabs 104*a-c*. The slabs 104*a-c* can extend laterally from the multi-sided core 100 and can generally be arranged at every floor of the concrete building structure. In one example, the slabs 104*a-c* can extend around the multi-sided core 100, including extending around the open face or open wall 102*d*.

The climbing system 110 can include one or more climbing brackets 112. One of the climbing brackets 112 can be releasably anchored to the left wall 102*a* and another of the climbing brackets 112 can be releasably anchored to the right wall 102*b*. In one example, each of the climbing brackets 112 can be releasably anchored to the respective walls 102*a-b* each by one or more anchor bolts (depicted in FIG. 2) in one or more corresponding anchor holes formed into the walls 102*a-b*.

The climbing system 110 can also include one or more working brackets 120. One of the working brackets 120 can be releasably anchored to the left wall 102*a* and another of the climbing brackets 120 can be releasably anchored to the right wall 102*b*. In one example, each of the climbing brackets 120 can be anchored to the respective walls 102*a-b* each by one or more anchor bolts (depicted in FIG. 2) in one or more corresponding anchor holes formed into the walls 102*a-b*.

Figure 2:
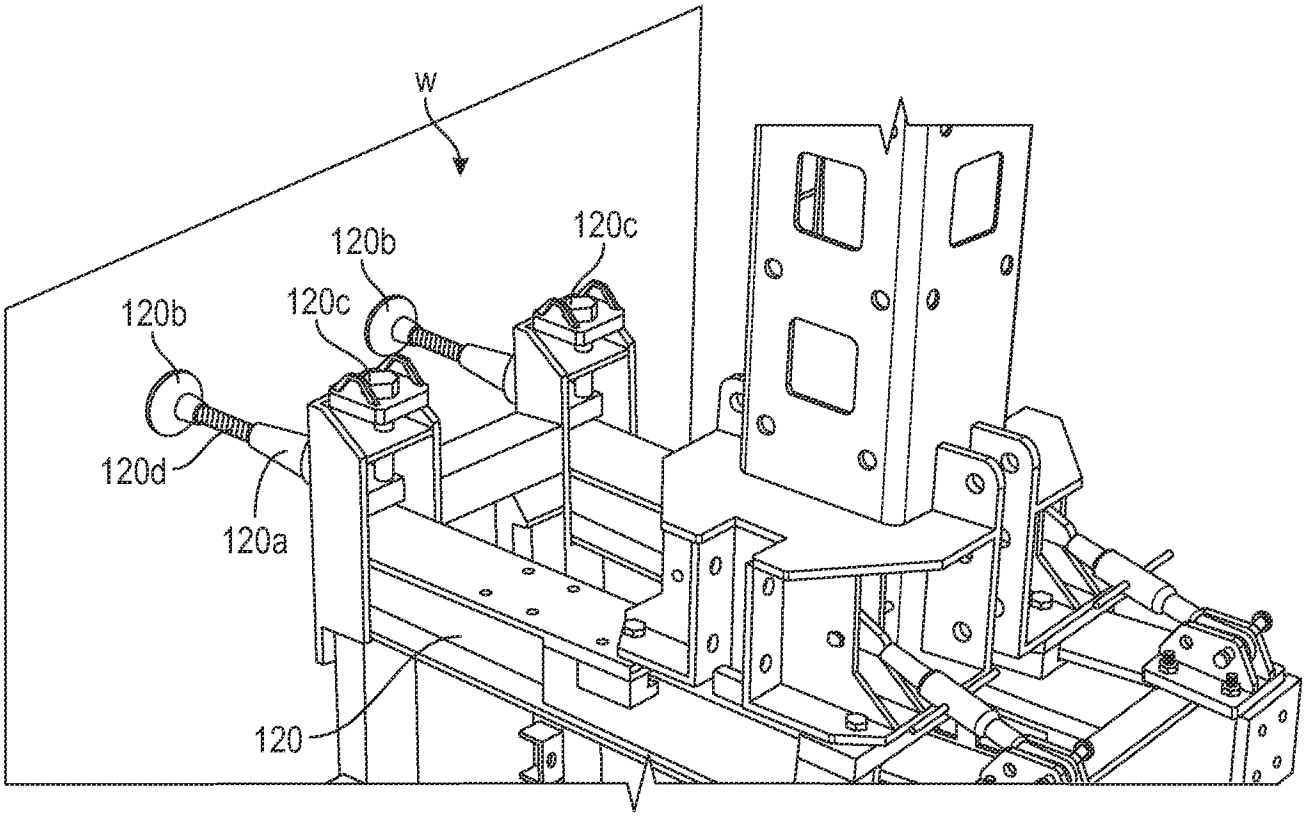
FIG. 2 is a perspective view of anchor bolts according to one or more aspects of the disclosure.

Turning to FIG. 2, an exemplary anchor bolt arrangement is depicted. As shown, a working bracket 120 is anchored to a wall W (e.g., left side wall 102*a*, right side wall 102*b*, or any other wall of the multi-sided core 100) by one or more anchor bolts 120*a* (also referred to as climbing cones) into corresponding anchor positions in the wall. This can be achieved by a threaded rod 120*d*, anchor plate 120*b*, and a locking mechanism 120*c* (also referred to as a sliding unit) on the working bracket 120. In operation, one or more (e.g., two or a pair) of anchor bolts 120*a* can be engaged with the wall W, for example by the threaded rod 120*d* and the anchor plate 120*b* engaged with the anchor bolts 120*a*. The anchor bolts 120*a* can be engaged at predetermined positions such that a spacing between them is equal to a spacing between corresponding locking mechanisms 120*c* on the working bracket 120 and the anchor bolts 120*a* are arranged at the same height.

At a wall side of the anchor bolt 120*a*, the threaded rod 120*d* includes an anchor plate 120*b*. During pouring, the threaded rod 120*d* and the anchor plate 120*b* are cast into the wall W, thus allowing the anchor plate 120*b* to be completely embedded within the wall W, the threaded road 120*d* is at least partially (or completely) embedded within the wall W, and the anchor bolt 120*a* at least partially (or completely) embedded within the wall W. The anchor bolt 120*a* can be disengaged from the anchor plate 120*b* and the threaded rod 120*d* by a hex or Allen key, allowing for the anchor bolt 120*a* to be used at differing anchor positions. In FIG. 2, anchor bolt 120*a*, anchor plate 120*b*, and threaded rod 120*d* are depicted in phantom as they are embedded within the wall W.

Once engaged, the working bracket 120 can be engaged with the anchor bolts 120*a* that are protruding from the wall and can be secured by the locking mechanism 120*c*, where the anchor bolts 120*a* can receive a hex bolt and the locking mechanism 120*c*. In this configuration the working bracket 120 abuts the wall W. In order to release the working bracket 120, the locking mechanism 120*c* is released, the hex bolt can be removed, and the working bracket 120 can be moved (typically climbed vertically), leaving the anchor bolts 120*a* protruding from the wall W. While a working bracket 120 is depicted as operable with the anchor bolts 120*a*, climbing brackets 112 of the present application can have an identical locking mechanism operable with corresponding anchor bolts.

Figure 1B:
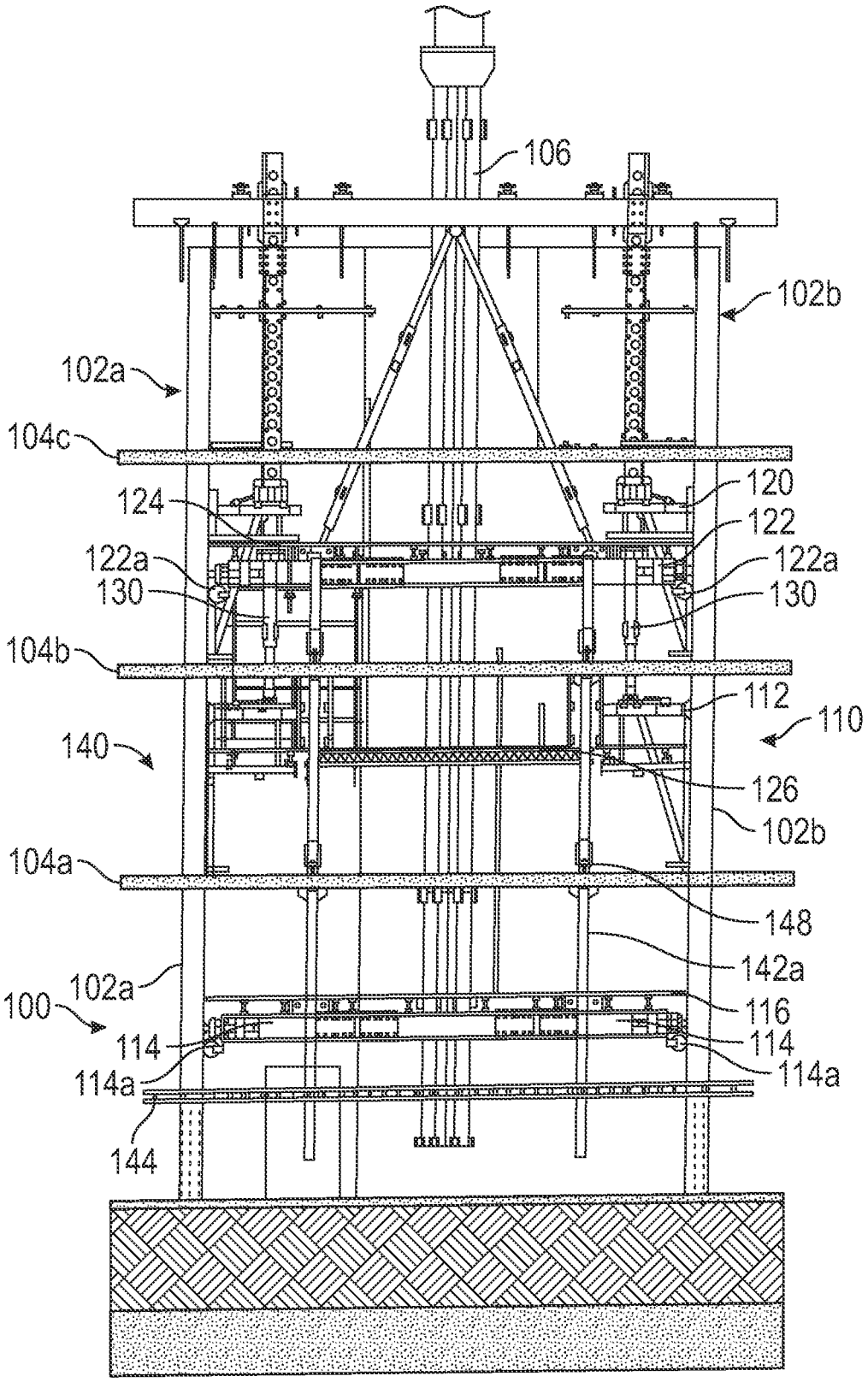

Returning to FIGS. 1A-C, the working brackets 120 can be engaged with a support frame 122 (also referred to as upper support frame or a first support frame) that can span a distance between the working brackets 120 in the multi-sided core 100 and can extended between two walls (e.g., opposing parallel walls 102*a* and 102*b*) of the multi-sided core 100. The support frame 122 can at least partially or completely surround a mast 106 associated with a concrete placing boom 108, thereby providing lateral and vertical support to the mast 106. A platform 124 can be disposed atop the support frame 122. In general, support frame 122, the associated platform 124, and the working brackets 120 together form the level 0 platform.

The climbing system 110 can also include an intermediate platform 126 also referred to as the level −1 platform that are suspended from the support frame 122.

The climbing system can also include a support frame 114 (also referred to as lower support frame or a second support frame) that can at least partially or completely surround a mast 106 associated with a concrete placing boom 108 and can extended between two walls (e.g., opposing parallel walls 102*a* and 102*b*) of the multi-sided core 100. A platform 116 can be disposed atop the support frame 114, with the support frame 114 providing lateral support to the mast 106. In general, support frame 114 and the associated platform 116 together form the level −2 platform and are suspended from support frame 122 by front and rear vertical supports 142*a-b*.

The support frames 114 and 122 provide lateral support to the mast 106 during climbing and pouring operations. In particular, the concrete placing boom 108 can be extended laterally during a pour operation. This exerts significant lateral force on the mast 106, which is accommodated by the support frames 114 and 122. As described below, a climbing support subsystem 140 can be implemented to accommodate for the lateral force generated in situations where the multi-wall core 100 includes three walls and defines an open face, or is otherwise non-rectangular or non-square.

The climbing system 110 can include one or more climbing cylinders 130 (e.g., hydraulic cylinder(s), single-stroke hydraulic cylinder(s)) for vertical climbing (also referred to as jumping) of the self-climbing system 110. For a single-stroke hydraulic cylinder system, the system can be climbed or advanced from one floor to the floor above it in a single stroke of the cylinder without the need for multiple strokes of the cylinder or an additional rail.

For example, each climbing bracket 112 and the working bracket 120 arranged above it can be associated with one climbing cylinder. Thus, in a system with a pair of climbing brackets 112 and a pair of working brackets 120, the system would include a pair of climbing cylinders 130. During a climbing operation, the climbing and working brackets can be climbed or jumped vertically to subsequent higher floors for subsequent climbing processes. Climbing cylinders 130 can be attached at one end to each of the working brackets 120 and at the other end to the climbing brackets 112 arranged underneath.

In the example where the multi-sided core 100 includes three walls (e.g., 102*a-c*) and defines an open face or open wall 102*d*, an additional climbing support subsystem 140 can be implemented in connection with the self-climbing system 110. The climbing support subsystem 140 can be disposed or located within the multi-sided core 100 (e.g., being disposed generally within the volume defined by the three walls 102*a-c* of the multi-sided core 100) during both a pouring operation and/or a climbing operation.

The climbing support subsystem 140 can include one or more front vertical supports 142*a*, one or more rear vertical supports 142*b*, one or more optional temporary trusses 144, one or more braces 146, and one or more guiding shoes 148.

Figure 1C:
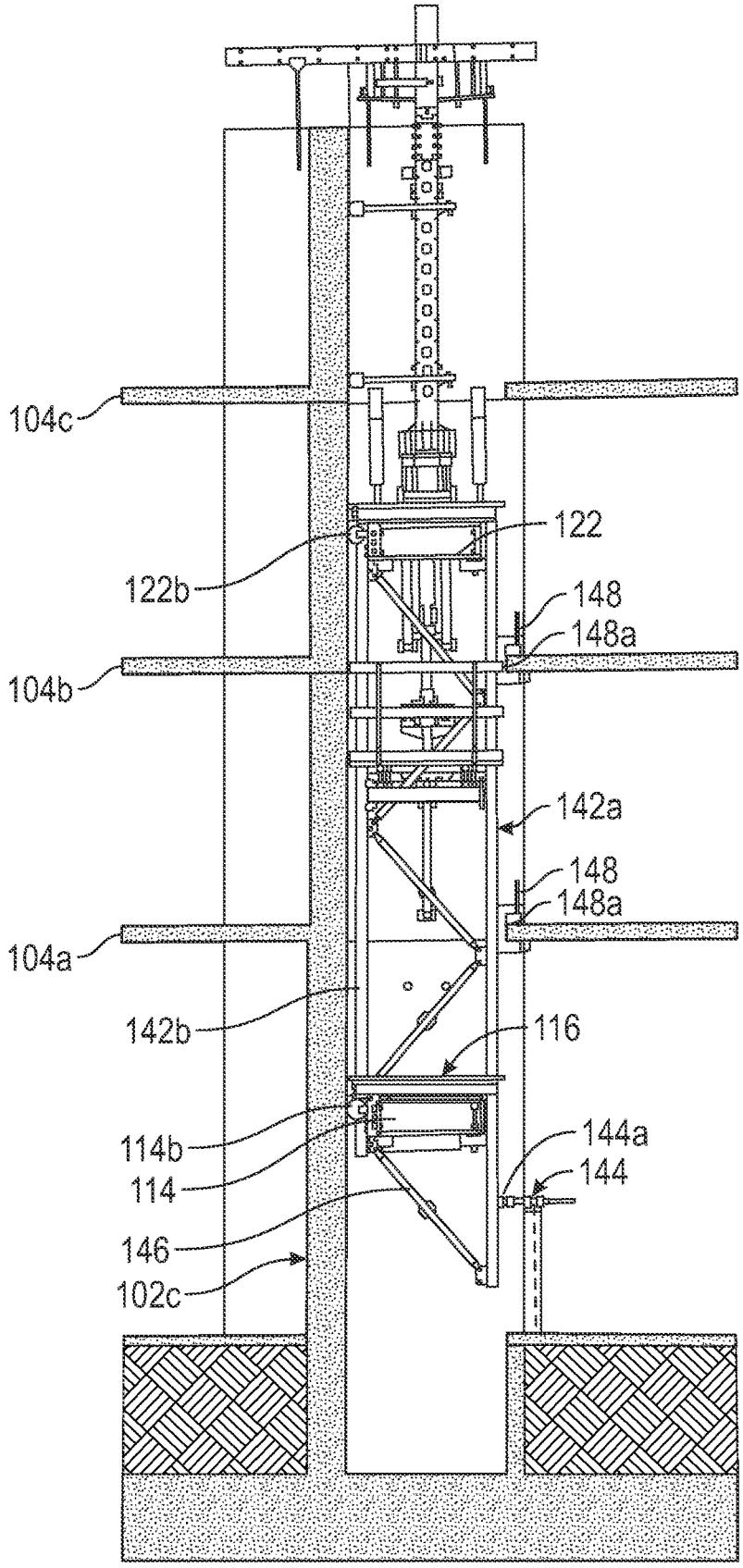

The front and rear vertical supports 142*a-b* can be formed of steel and can be suspended from support frame 122 and can be either permanently or temporarily engaged (e.g., bolted) with the support frame 122. The front and rear vertical supports 142*a-b* can be any length, and in some examples can have a length of at least a distance between support frame 122 and 114. As shown in FIG. 1C, the front vertical supports 142*a* can be longer than the rear vertical supports 142*b*. In other examples, the vertical supports 142*a, b* can be the same or substantially the same length. As shown, the level −2 platform 116, including support frame 114, can be suspended from support frame 122 via the vertical supports 142*a, b* such that vertical climbing of the support frame 122 results in corresponding vertical climbing of the level −2 platform (e.g., platform 116 and support frame 114).

The climbing support subsystem 140 can also include one or more braces 146 that extend between the front vertical supports 142*a* and the rear vertical supports 142*b* at an angle. As shown in FIG. 1C, one end of each of the braces 146 can be attached to a front vertical support 142*a* and the other end of the brace 146 can be attached to the rear vertical support 142*b* in an alternating manner. The braces can be arranged vertically between a lower end of the front vertical supports 142*a* (or rear vertical supports 142*b*) and up to a region between the support frame 122 and the intermediate platform 126.

An angle of connection relative to the vertical can be in the range of 30-60 degrees, depending on dimensions of the multi-sided core 100, and in one example can be approximately 45 degrees. The braces 146 can in some examples be spindles that have an adjustable or fixed length. For example, the spindles can be rotated to lengthen or shorten the spindles according to the parameters of the project. The braces 146 can be any length, and in some examples can be in the range of 5 to 8 feet. The braces 146 can be removably engaged with the vertical support members 142*a, b*, for example by being anchored to fins or tabs that are welded to the vertical support members 142*a, b*.

Figure 3:
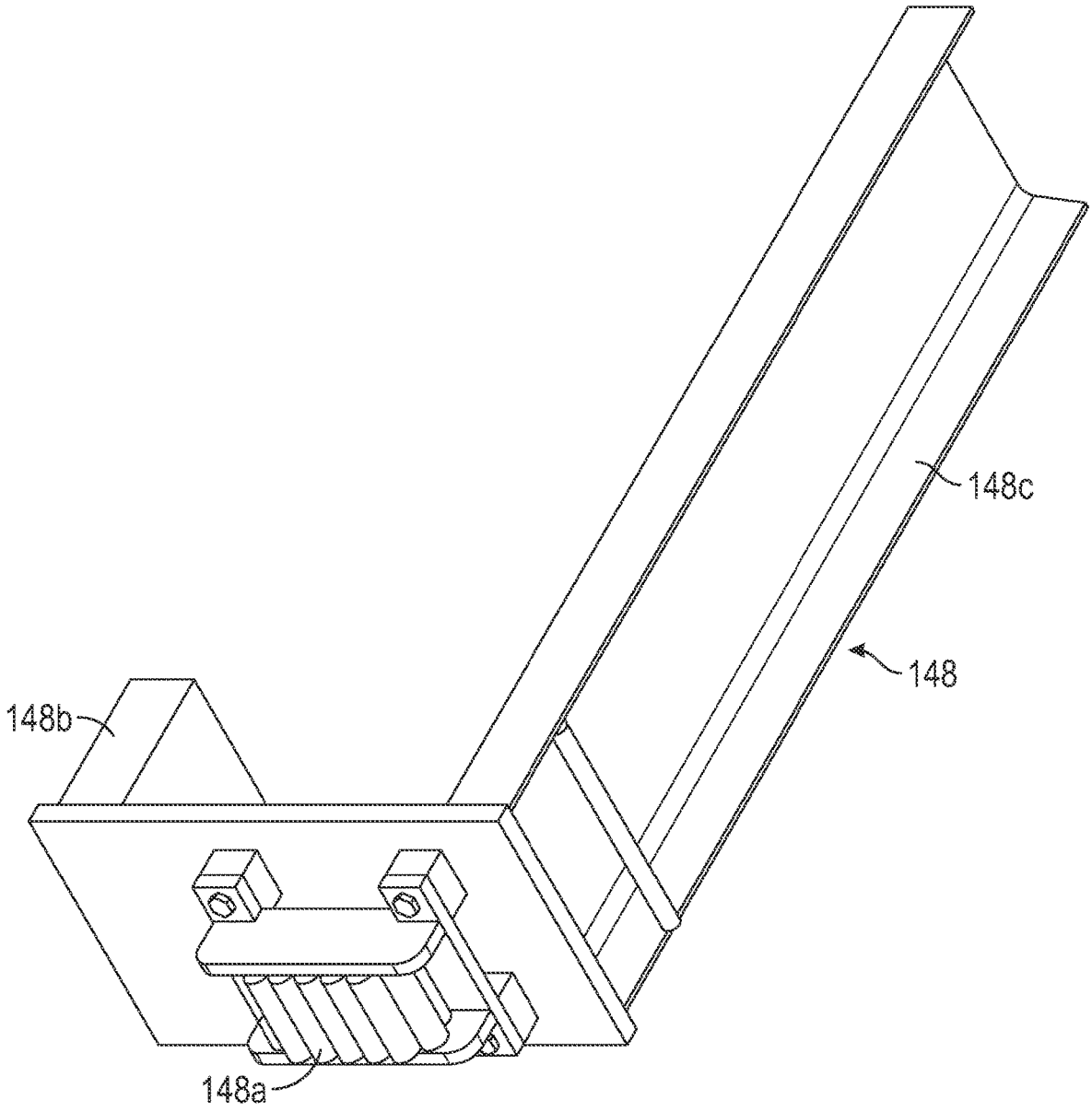
FIG. 3 is a perspective view of a guiding shoe according to one or more aspects of the disclosure.

With reference to FIGS. 1A-C and FIG. 3, the climbing support subsystem 140 can also include one or more guiding shoes 148. As shown, each of the guiding shoes 148 can be attached to one of the slabs 104*a-c* of the multi-sided core 100, with the guiding shoes having respective engagement portions 148*b-c* for engaging with an upper and lower surface of the slab, respectively. The guiding shoes 148 can engage with the slabs 104*a-c* by any type of connection, such as an anchor bolt, clamping arrangement (e.g., clamping a top surface and a bottom surface of the slab), or any other type. As shown in FIG. 1C, each the front vertical supports 142*a* bears against one or more guiding shoes 148 at any given time during a pouring position or a climbing position of the climbing system 110, thereby guiding the front vertical supports in a vertical manner during a climbing operation. A bearing surface 148*a* of the guiding shoes 148 can be designed to bear against the front vertical supports 142*a* and allow vertical movement of the front vertical supports 142*a* during a climbing process. In some examples, the bearing surface 148*a* is a flat metal surface of the guiding shoe 148 that can optionally be lubricated to allow for vertical motion. In other examples, the bearing surface 148*a* is a single rotating cylinder (e.g., roller bearing) that can rotate about an axis or an array (e.g., plurality) of rotating cylinders (e.g., roller bearings) as shown in FIG. 3 that can all rotate about parallel axes.

The subsystem 140 can optionally include a temporary truss 144. The temporary truss can be used in a multi-sided core where a first floor of a building can have a greater height than the remaining floors, for example as a lobby or other type of floor having a higher ceiling. In this regard, the temporary truss 144 may be placed where a slab does not exist due to the increased height of the floor. The temporary truss can act as a slab and the front vertical supports 142*a* can bear against a bearing surface 144*a* of the temporary truss 144. The bearing surface 144*a* can be a flat metal surface of the truss 144 that can optionally be lubricated to allow for vertical motion. In other examples, the bearing surface 144*a* is a single rotating cylinder (e.g., roller bearing) that can rotate about an axis or an array (e.g., plurality) of rotating cylinders (e.g., roller bearings) as shown in FIG. 3 that can all rotate about parallel axes.

Figure 4A:
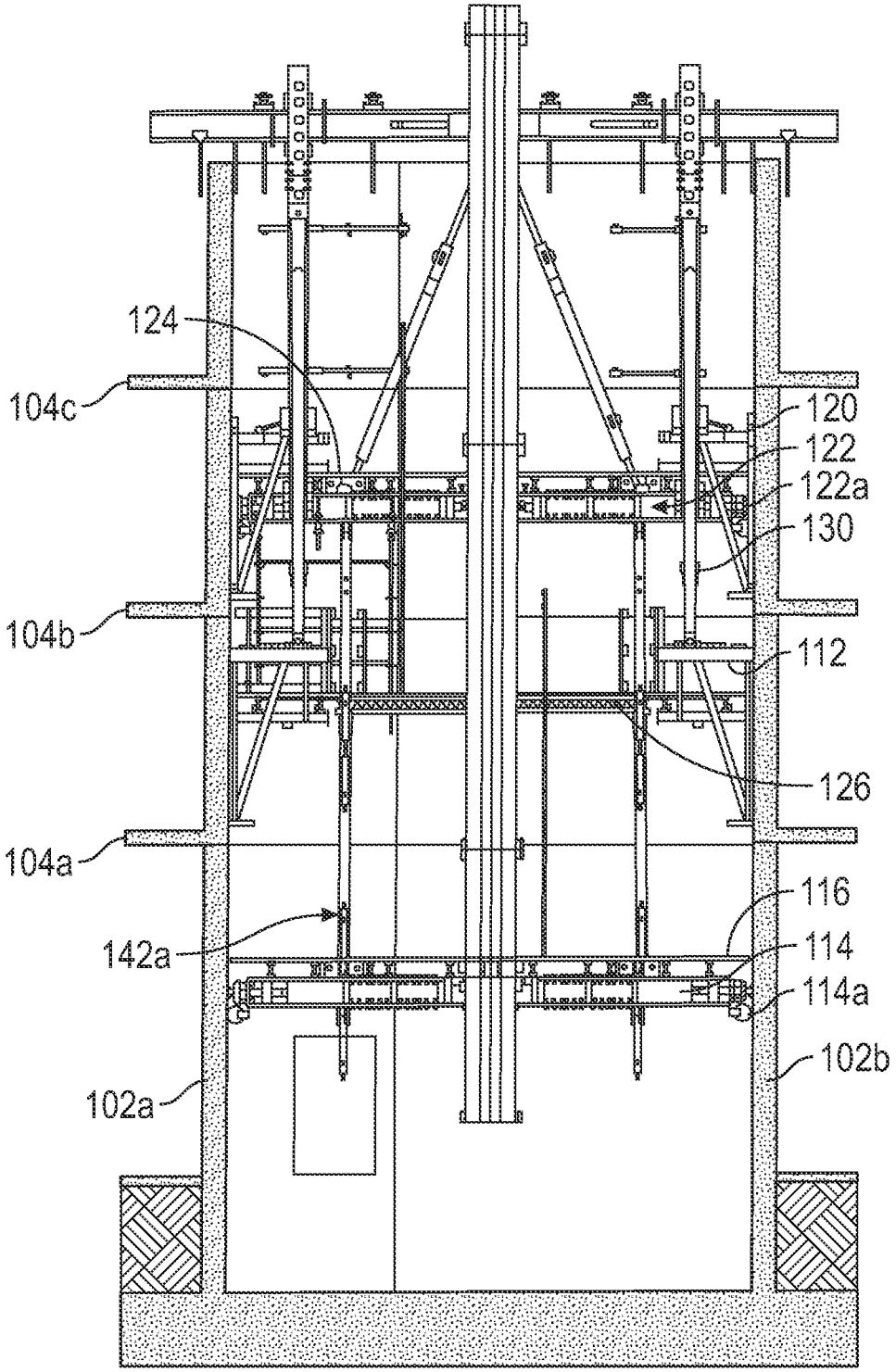
FIGS. 4A-B are front views of a multi-sided core with a self-climbing system in a pouring position and a climbing position according to one or more aspects of the disclosure.
Figure 4B:
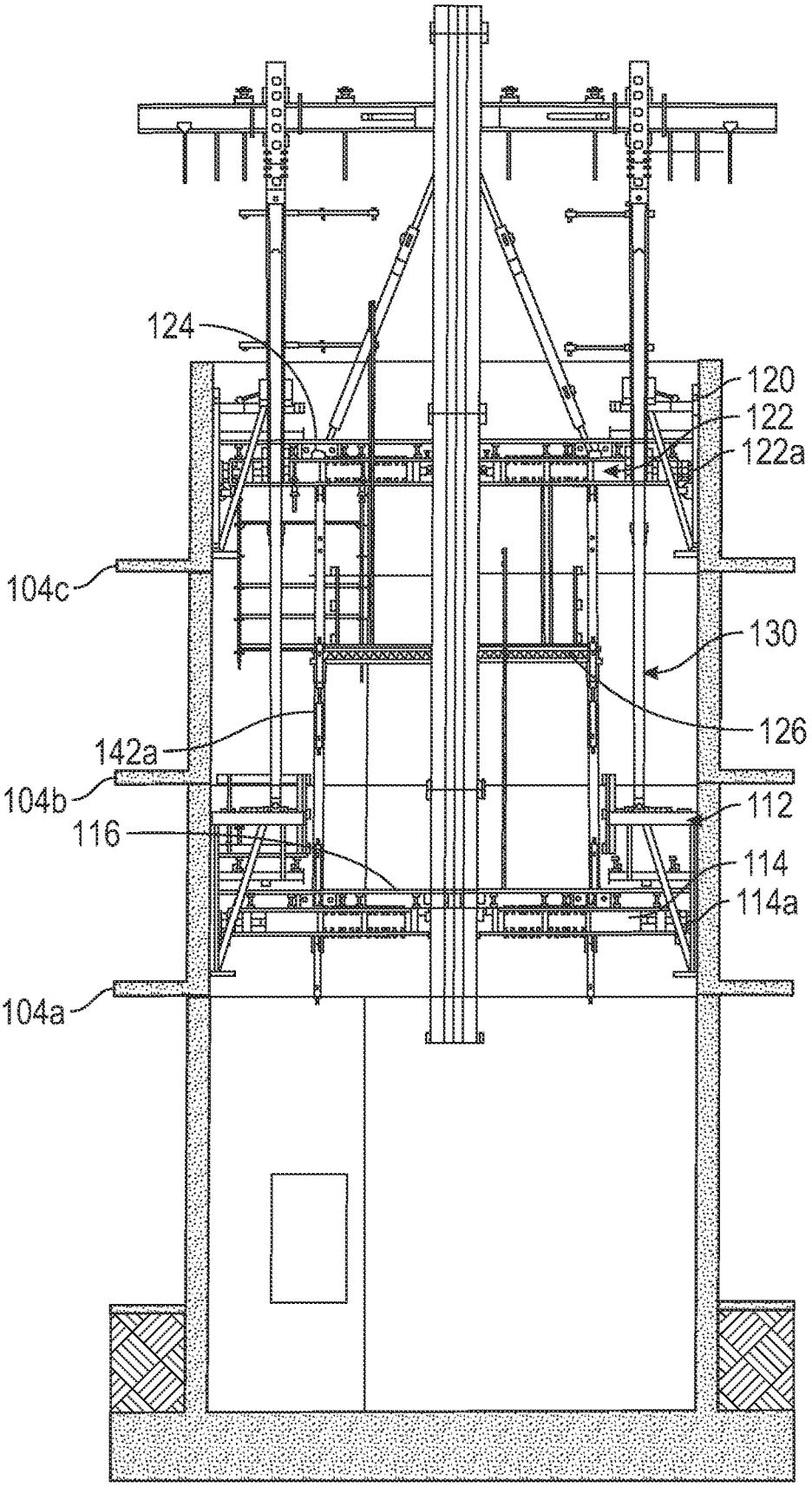

FIG. 4A depicts a multi-sided core with a self-climbing system and a climbing support subsystem 140 in the pouring position and FIG. 4B depicts the multi-sided core with a self-climbing system and a climbing support subsystem 140 mid-climb during a climbing procedure.

In the pouring position of FIG. 4A, the level −2 platform 116 is located beneath the slab 104*a* at an anchor point (e.g., second anchor point), the level −1 platform (e.g., climbing bracket 112 and intermediate platform 126) is located between slab 104*a* and slab 104*b*, and the level 0 platform is located above slab 104*b* and beneath slab 104*c* at another anchor point (e.g., first anchor point).

During a climbing operation, the working brackets 120 can first be disengaged from the walls 102*a, b* at the first anchor point by disengaging the working brackets 120 from anchor bolts (e.g., 112*a* of FIG. 2) engaged with the anchor holes. This disengagement of working brackets 120 results in the disengagement of the support frame 124 from the multi-sided wall by virtue of their interconnection. During this step, the climbing brackets 112 maintain their engagement with the walls 102*a, b* at the second anchor point.

Once disengaged, the working brackets 120 are climbed vertically to engage with anchor bolts in anchor holes of a new wall section (e.g., wall section above slab 104*c* in FIG. 4B) at a new anchor point above the first and second anchor point. In this regard, the climbing cylinder 130 is activated in order to raise the support frame 122 and the working brackets 120. The vertical climbing is performed by virtue of the climbing cylinder 130, which can extend by a hydraulic force and exerts a vertical force on the working brackets 120 by virtue of the climbing brackets 112 being engaged with wall sections and being vertically stationary.

During the climbing of working brackets 120, the level −2 platform (e.g., support frame 114 and platform 116) and the level −1 platform (intermediate platform 126) are also climbed vertically by virtue of the suspended arrangement with support frame 122, which moves in a corresponding manner with working brackets 120. In this regard, the front and rear vertical supports 142*a, b* and braces also climb vertically by virtue of their connection with support frame 122. During this climbing, the bearing surface 148*a* of the one or more guiding shoes 148 and/or bearing surface 144*a* of the temporary truss 144 can bear against the vertically moving front vertical supports 142*a* and the guiding shoes 148 and bearing surface 148*a* can guide the front vertical support members 142*a* during the climbing process. In the example where one or more of the bearing surfaces 144*a* and/or 148*a* are one or more rotating cylinders or roller bearings, the vertical supports 142*a* are easily moved vertically without excessive friction relative to the guiding shoes 148.

During the raising, lateral portions of frame 122 roll against the walls 102*a, b* via rollers 122*a*. A rear portion of frame 122 rolls against the rear wall 102*c* via rollers 122*b*. Similarly, lateral portions of support frame 114 roll against the walls 102*a, b* via rollers 114*a* and rear portion of frame 114 rolls against the rear wall 102*c* via rollers 114*b*.

As shown in FIG. 4B, once the working brackets 120 are raised to the correct height at the new anchor point, the working brackets 120 are thus engaged with the new anchor bolts (e.g., 112*a*) installed in anchor holes in the new wall section (e.g., wall section above slab 104*c*) at the new anchor point. Once engaged, the climbing brackets 112 are disengaged with the walls at the second anchor point while the working brackets 120 are engaged with the new wall section.

Subsequent to the position depicted in FIG. 4B, the climbing cylinder 130 contracts vertically, thus providing for a climbing operation of the climbing brackets 112 by virtue of the stationary working brackets 120. In one example, the climbing brackets 112 are climbed to a position previously occupied by the working brackets 120 (e.g., climbed from the second anchor point to the first anchor point) such that the climbing brackets 112 can engage with the anchor bolts (e.g. 112*a*) formerly engaged with the now raised working brackets 120. This prevents excessive anchor holes to be formed in the concrete structures.

Subsequently, the climbing brackets 112 can be raised in the climbing operation and can engage with the anchor holes that were previously occupied by the working brackets 120. The climbing system 110 is now in a subsequent pouring position and the climbing process can be continued upon pouring of a new wall section.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A climbing support subsystem for use with a self-climbing system, comprising:

a plurality of guiding shoes configured to engage with one or more slabs of a multi-wall core, each of the guiding shoes having a bearing surface;

at least one front vertical support member configured to engage with a support frame of a self-climbing system;

at least one rear vertical support member configured to engage with the support frame of a self-climbing system; and a plurality of braces extending between the at least one front vertical support member and the at least one rear vertical support member, wherein, during a climbing operation, the at least one front vertical support member is configured to bear against the respective bearing surfaces of the plurality of guiding shoes.

2. The climbing support subsystem of claim 1, wherein the multi-wall core comprises a three-walled core defining an open face.

3. The climbing support subsystem of claim 1, wherein the respective bearing surfaces comprise roller bearing surfaces.

4. The climbing support subsystem of claim 1, further comprising a temporary truss configured to engage with walls of the multi-wall core.

5. The climbing support subsystem of claim 1, wherein:
the at least one front vertical support member comprises a plurality of front vertical support members, and
the at least one rear vertical support member comprises a plurality of rear vertical support members.

6. The climbing support subsystem of claim 5, wherein the plurality of front vertical support members bear against a plurality of second bearing surfaces of the temporary truss.

7. The climbing support subsystem of claim 1, wherein each of the plurality of braces engages with both the at least one front vertical support member and the at least one rear vertical support member.

8. The climbing support subsystem of claim 1, wherein the plurality of guiding shoes are configured to engage with the slabs in a clamping arrangement.

9. The climbing support subsystem of claim 1, wherein the climbing support subsystem is configured to be disposed within the multi-sided core.

10. A self-climbing system comprising:
a plurality of working brackets configured to engage with walls of a multi-sided core to support a support frame;
a plurality of climbing brackets configured to engage with walls of the multi-sided core; and
a climbing support subsystem, comprising:
a plurality of guiding shoes configured to engage with a slab of a multi-wall core, each of the guiding shoes having a bearing surface;
at least one front vertical support member suspended from the support frame;
at least one rear vertical support member suspended from the support frame; and
a plurality of braces extending between the at least one front vertical support member and the at least one rear vertical support member,
wherein, during a climbing operation, the plurality of front vertical support members are configured to bear against the respective bearing surfaces of the plurality of guiding shoes.

11. The self-climbing system of claim 10, further comprising:
a plurality of climbing cylinders configured to engage with the plurality of working brackets and the plurality of climbing brackets.

12. The self-climbing system of claim 11, wherein the plurality of climbing cylinders comprise single-stroke hydraulic climbing cylinders.

13. The self-climbing system of claim 10, wherein the climbing support subsystem is disposed within the multi-sided core.

14. The self-climbing system of claim 10, wherein the at least one front vertical support member is engaged with the support frame.

15. The self-climbing system of claim 10, wherein the multi-wall core comprises a three-walled core defining an open face.

16. The self-climbing system of claim 10, wherein the respective bearing surfaces comprise roller bearing surfaces.

17. The self-climbing system of claim 10, wherein the climbing support subsystem further comprises a temporary truss configured to engage with walls of the multi-wall core.

18. The self-climbing system of claim 10, wherein:
the at least one front vertical support member comprises a plurality of front vertical support members, and
the at least one rear vertical support member comprises a plurality of rear vertical support members.

19. The self-climbing system of claim 18, wherein the plurality of front vertical support members bear against a plurality of second bearing surfaces of the temporary truss.

20. The self-climbing system of claim 18, further comprising a second support frame suspended from the support frame by the plurality of front vertical support members engaged with the support frame and the second support frame and the plurality of rear vertical support members engaged with the support frame and the second support frame.

21. The self-climbing system of claim 10, wherein each of the plurality of braces engages with both the at least one front vertical support member and the at least one rear vertical support member.

22. The self-climbing system of claim 10, wherein the support frame extends between two parallel walls of the multi-sided core.

23. A method of operating a self-climbing system relative to a multi-side core, comprising:
disengaging at least one working bracket from at least a first anchor point of the multi-side core;
climbing the at least one working bracket and at least one support frame engaged with the at least one working bracket,
during the climbing, guiding a plurality of front vertical supports suspended from the support frame via a plurality of guiding shoes engaged with at least one slab of the multi-side core;
engaging the at least one working bracket with a second anchor point of the wall section of the multi-side core above the first anchor point;
disengaging at least one climbing bracket from a third anchor point of the multi-side core; and
climbing the at least one climbing bracket to the second anchor point.

24. The method of claim 23, wherein during the climbing of the at least one working bracket, the plurality of front vertical supports bear against a bearing surface of the plurality of guiding shoes.

25. The method of claim 24, wherein the bearing surface comprises a roller bearing surface.

* * * * *